US010034081B2

(12) United States Patent
Tipparaju et al.

(10) Patent No.: US 10,034,081 B2
(45) Date of Patent: Jul. 24, 2018

(54) ACOUSTIC FILTER FOR OMNIDIRECTIONAL LOUDSPEAKER

(71) Applicant: Samsung Electronics Co., Ltd., Suwon-si, Gyeonggi-do (KR)

(72) Inventors: Lakshmikanth Tipparaju, Valencia, CA (US); Allan Devantier, Newhall, CA (US); William Decanio, Valencia, CA (US); Andri Bezzola, Pasadena, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/141,594

(22) Filed: Apr. 28, 2016

(65) Prior Publication Data

US 2017/0094403 A1 Mar. 30, 2017

Related U.S. Application Data

(60) Provisional application No. 62/233,927, filed on Sep. 28, 2015.

(51) Int. Cl.
*H04R 1/28* (2006.01)

(52) U.S. Cl.
CPC ..... *H04R 1/288* (2013.01); *H04R 2201/029* (2013.01)

(58) Field of Classification Search
CPC ..... H04R 1/30; H04R 1/345; H04R 2201/34
See application file for complete search history.

(56) References Cited

U.S. PATENT DOCUMENTS 3,649,776 A 3/1972 Burton
3,912,866 A * 10/1975 Fox ..... H04R 1/2865 181/155
4,157,741 A 6/1979 Goldwater
4,322,578 A * 3/1982 Selmin ..... H04R 1/345 181/175
4,336,861 A 6/1982 Peter
4,348,549 A * 9/1982 Berlant ..... H04R 1/26 181/152
4,348,750 A 9/1982 Schwind
4,876,723 A 10/1989 Fang
(Continued)

FOREIGN PATENT DOCUMENTS

EP 0485284 A1 5/1992
JP 2004343229 A 12/2004
(Continued)

OTHER PUBLICATIONS

International Search Report and Written Opinion dated Dec. 29, 2016 for International Application No. PCT/KR2016/010650 from Korean Intellectual Property Office, pp. 1-12, Daejeon, Republic of Korea.

(Continued)

*Primary Examiner* — Matthew Eason
(74) *Attorney, Agent, or Firm* — Sherman IP LLP; Kenneth L. Sherman; Hemavathy Perumal

(57) ABSTRACT

One embodiment provides an omnidirectional loudspeaker comprising a phase plug and an acoustic resonator within the phase plug. The acoustic resonator comprises acoustic damping material.

20 Claims, 21 Drawing Sheets

(56) References Cited

U.S. PATENT DOCUMENTS 5,115,882 A * 5/1992 Woody ..... H04R 1/345 181/144
5,261,006 A 11/1993 Nieuwendijk et al.
5,306,880 A 4/1994 Cozair et al.
5,451,726 A 9/1995 Haugum
5,521,983 A 5/1996 Thompson et al.
5,673,329 A 9/1997 Wiener
5,886,304 A 3/1999 Schlenzig
5,952,620 A 9/1999 Hamilton
5,995,634 A 11/1999 Zwolski
6,009,972 A 1/2000 Choi et al.
6,026,928 A * 2/2000 Maharaj ..... H04R 1/30 181/152
6,785,397 B2 8/2004 Arnstein
6,820,718 B2 11/2004 Lacarrubba
6,950,530 B2 9/2005 Baird et al.
7,236,606 B2 6/2007 Werner
7,587,227 B2 9/2009 Cheung
7,614,479 B2 11/2009 Plummer
7,920,712 B2 4/2011 Butler
8,014,545 B2 9/2011 Grant
8,027,500 B2 9/2011 Fincham
8,081,766 B2 12/2011 Gunness
8,116,500 B2 2/2012 Oxford et al.
8,121,330 B2 2/2012 Dodd et al.
8,130,994 B2 * 3/2012 Button ..... H04R 1/24 181/155
8,181,736 B2 5/2012 Sterling et al.
8,199,953 B2 6/2012 Buccafusca
8,280,091 B2 10/2012 Voishvillo
8,290,195 B2 * 10/2012 Chick ..... H04R 1/36 181/175
8,418,802 B2 * 4/2013 Sterling ..... H04R 1/2803 181/176
8,428,284 B2 4/2013 Meyer et al.
8,467,557 B2 * 6/2013 Miller ..... H04R 1/24 381/182
8,638,959 B1 1/2014 Hall
8,672,088 B2 * 3/2014 Sterling ..... H04R 1/2803 181/176
8,750,540 B2 * 6/2014 Tan ..... H04R 1/345 181/144
8,857,559 B2 10/2014 Reviel
8,873,787 B2 10/2014 Bergere
9,060,219 B2 6/2015 Guenther
9,173,018 B2 10/2015 Silver et al.
9,282,398 B2 * 3/2016 Monroe ..... H04R 1/22
9,549,242 B2 1/2017 Silver et al.
2002/0118858 A1 8/2002 White
2005/0175207 A1 8/2005 Alexander et al.
2008/0107291 A1 5/2008 Livingston
2008/0192972 A1 * 8/2008 Lewallen ..... H04R 23/00 381/343
2010/0027833 A1 2/2010 Takahashi
2011/0019854 A1 1/2011 Graber
2012/0219171 A1 8/2012 Velican
2013/0228393 A1 9/2013 Sterling et al.
2014/0003645 A1 1/2014 Silver et al.
2014/0029781 A1 1/2014 Valtchev et al.
2014/0185854 A1 7/2014 Murphy
2016/0227315 A1 * 8/2016 Kim ..... H04R 1/2819
2017/0094406 A1 3/2017 Bezzola

FOREIGN PATENT DOCUMENTS

KR 101510692 B1 4/2015
WO 2015094115 A1 6/2015

OTHER PUBLICATIONS

U.S. Restriction Requirement for U.S. Appl. No. 15/141,594, dated Mar. 12, 2018 by Examiner Huyen D. Le.

* cited by examiner

ACOUSTIC FILTER FOR OMNIDIRECTIONAL LOUDSPEAKER

CROSS-REFERENCE TO RELATED APPLICATIONS

The present application claims priority to U.S. Provisional Patent Application No. 62/233,927, filed on Sep. 28, 2015. Further, the present application is related to commonly-assigned, co-pending U.S. Non-Provisional patent application Serial No. 15/141,161, filed on Apr. 28, 2016 entitled "THREE HUNDRED AND SIXTY DEGREE HORN FOR OMNIDIRECTIONAL LOUDSPEAKER", filed on the same day as the present application. Both patent applications are hereby incorporated by reference in its entirety.

TECHNICAL FIELD

One or more embodiments relate generally to loudspeakers, and in particular, a physical acoustic filter for an omnidirectional loudspeaker.

BACKGROUND

A loudspeaker reproduces audio when connected to a receiver (e.g., a stereo receiver, a surround receiver, etc.), a television (TV) set, a radio, a music player, an electronic sound producing device (e.g., a smartphone), video players, etc. A loudspeaker may comprise a speaker cone, a horn or another type of device that forwards most of the audio reproduced towards the front of the loudspeaker.

SUMMARY

One embodiment provides an omnidirectional loudspeaker comprising a phase plug and an acoustic resonator within the phase plug. The acoustic resonator comprises acoustic damping material.

Another embodiment provides a method for producing a phase plug for an omnidirectional loudspeaker. The method comprises identifying resonances in a cavity of the omnidirectional loudspeaker to remove and fabricate a phase plug for removing acoustic amplification generated by the resonances. The phase plug comprises an acoustic resonator including acoustic damping material.

One embodiment provides a method for removing acoustic amplification in a cavity between a diaphragm and a phase plug of an omnidirectional loudspeaker. The method comprises generating, utilizing a sound source of the omnidirectional loudspeaker, sound and removing acoustic amplification generated by resonances in the cavity by attenuating, utilizing an acoustic resonator of the phase plug, the sound at a pre-selected frequency. The acoustic resonator comprises an acoustic damping material.

These and other features, aspects and advantages of the one or more embodiments will become understood with reference to the following description, appended claims and accompanying figures.

DETAILED DESCRIPTION

The following description is made for the purpose of illustrating the general principles of one or more embodiments and is not meant to limit the inventive concepts claimed herein. Further, particular features described herein can be used in combination with other described features in each of the various possible combinations and permutations. The term "on" includes when components or elements are in physical contact and also when components or elements are separated by one or more intervening components or elements. Unless otherwise specifically defined herein, all terms are to be given their broadest possible interpretation including meanings implied from the specification as well as meanings understood by those skilled in the art and/or as defined in dictionaries, treatises, etc.

One or more embodiments relate generally to loudspeakers, and in particular, a physical acoustic filter for an omnidirectional loudspeaker. One embodiment provides an omnidirectional loudspeaker comprising a phase plug and an acoustic resonator within the phase plug. The acoustic resonator comprises acoustic damping material.

Another embodiment provides a method for producing a phase plug for an omnidirectional loudspeaker. The method comprises identifying resonances in a cavity of the omnidirectional loudspeaker to remove and fabricate a phase plug for removing acoustic amplification generated by the resonances. The phase plug comprises an acoustic resonator including acoustic damping material.

One embodiment provides a method for removing acoustic amplification in a cavity between a diaphragm and a phase plug of an omnidirectional loudspeaker. The method comprises generating, utilizing a sound source of the omnidirectional loudspeaker, sound and removing acoustic amplification generated by resonances in the cavity by attenuating, utilizing an acoustic resonator of the phase plug, the sound at a pre-selected frequency. The acoustic resonator comprises an acoustic damping material.

Figure 1:
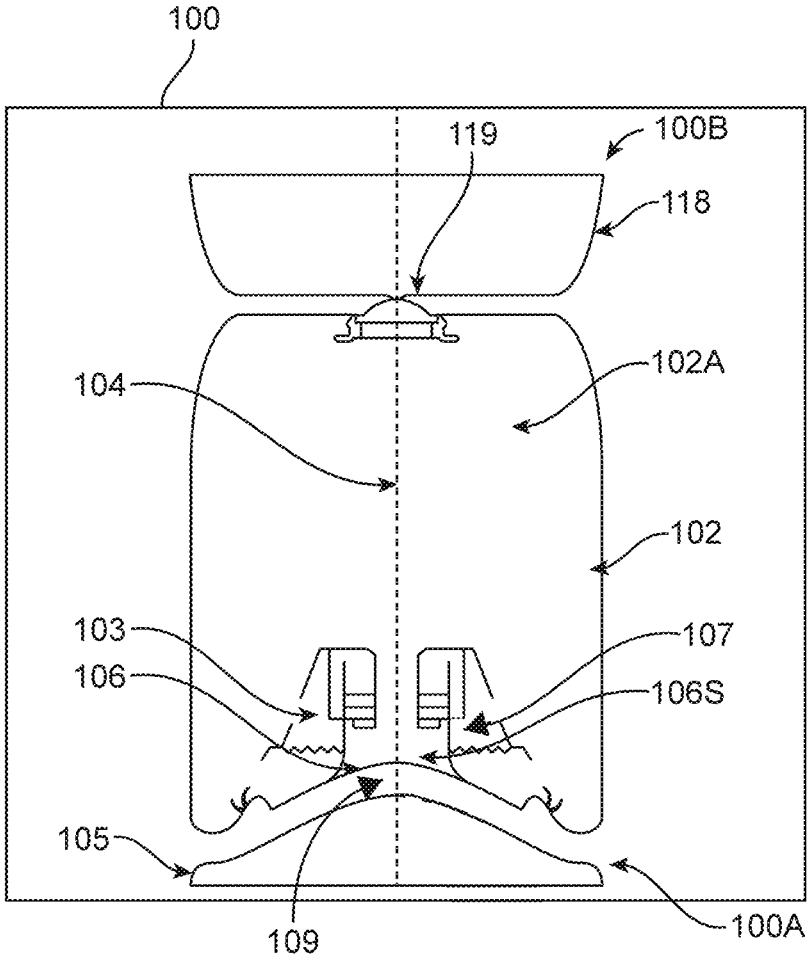
FIG. 1 illustrates an exemplary cross-section of an omnidirectional loudspeaker.

FIG. 1 illustrates an exemplary cross-section of an omnidirectional loudspeaker 100. The loudspeaker 100 is rotationally symmetric about an axis of symmetry 104. The loudspeaker 100 comprises a first axisymmetric loudspeaker enclosure 102 ("first enclosure"), a second axisymmetric loudspeaker enclosure 118 ("second enclosure"), and a phase plug 105. The phase plug 105 is positioned at a bottom section 100A of the loudspeaker 100. The second enclosure 118 is positioned at a top section 100B of the loudspeaker 100. The first enclosure 102 is positioned in between the second enclosure 118 and the phase plug 105. A cavity (i.e., a gap) 109 separates a bottom section of the first enclosure 102 and a top section of the phase plug 105.

A sound source is disposed within the first enclosure 102. In one embodiment, the sound source comprises a woofer loudspeaker driver 103. In another embodiment, the sound source comprises a tweeter loudspeaker driver 119 positioned/mounted axially inside the first enclosure 102 or the second enclosure 118.

Figure 6A:
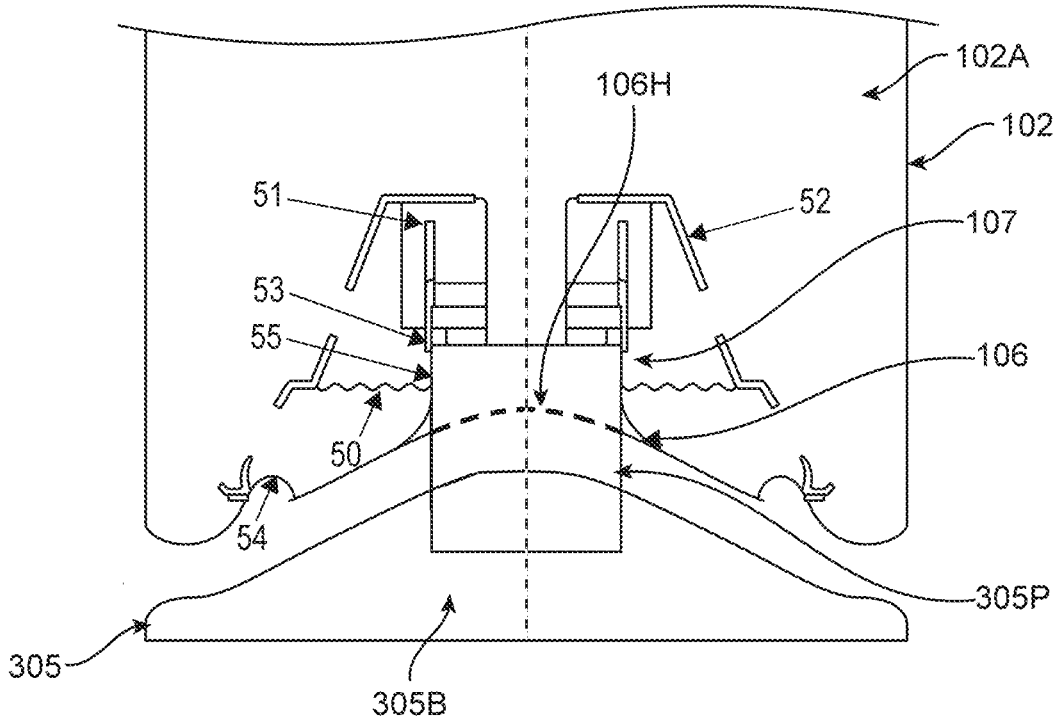
FIG. 6A illustrates a cross-section of an example protruding phase plug for an omnidirectional loudspeaker, in accordance with an embodiment.

The first enclosure 102 further comprises a diaphragm 106 and a transducer 107. With reference to FIG. 6A, the transducer 107 comprises a motor structure 51, a voice coil 53, a voice coil former 55, a spider structure 50, a surround structure 54, and a frame structure 52. The loudspeaker 100 reproduces audio (i.e., emits sound) only when it is powered on. The diaphragm 106 is an example radiating surface that vibrates when the loudspeaker 100 is reproducing audio. When the loudspeaker 100 is not reproducing audio, the diaphragm 106 is at a rest position, as shown in FIG. 1. A region 106S of space separates the diaphragm 106 and the transducer 107. A portion of the phase plug 105 is positioned directly across from the diaphragm 106, in the path of sound propagation.

During reproduction of audio, the loudspeaker 100 may exhibit large peaks and dips in frequency response curves due to resonances in the cavity 109. Resonances are typically equalized using conventional methods such as Digital Signal Processing (DSP), equalization circuits, etc. These conventional methods, however, are ineffective at removing resonances in the cavity 109. Instead, these conventional methods attenuate a signal going into the loudspeaker 100 at frequencies of the resonances in the cavity 109. The resonances in the cavity 109 act as an acoustic amplifier that re-amplifies the attenuated signal to a desired level. Therefore, distortion components in a frequency region around the resonances in the cavity 109 are amplified by the resonances but are not attenuated by an equalizer, thereby negatively impacting sound quality of the loudspeaker 100.

One or more embodiments of the invention provide a physical acoustic filter for a loudspeaker providing omnidirectional sound distribution. In one embodiment, the acoustic filter comprises an acoustic resonator filled with sound absorbing material (i.e., acoustic damping material). The acoustic filter may be used to attenuate peaks and dips in frequency response curves for the loudspeaker at a specific frequency. The acoustic filter may also be used to attenuate resonances. For example, the acoustic filter may reduce distortion amplification and damp resonances in the cavity 109. The acoustic filter is positioned directly across one or more distortion inducing elements of the loudspeaker.

One embodiment provides a physical acoustic filter that may be integrated into a phase plug of a loudspeaker to attenuate one or more peaks in omnidirectional sound distribution. Acoustic damping characteristics of the sound absorbing material tunes a Q-factor of attenuation to a Q-factor of resonance to reduce dips in the sound distribution and dips in frequency response curves caused by resonances in the cavity 109. The acoustic filter allows a sound source of the loudspeaker to be used at a wider band of frequencies; otherwise, dips in frequency response curves around the resonances may severely limit bandwidth at which the loudspeaker can produce significant sound levels. Dips in frequency response curves are more difficult to equalize at a level of an input signal because additional energy is required to enhance the input signal. The acoustic filter reduces some of the acoustic phenomena that create dips in frequency response curves, thereby eliminating burden on an equalizer and enhancing sound quality.

Figure 2:
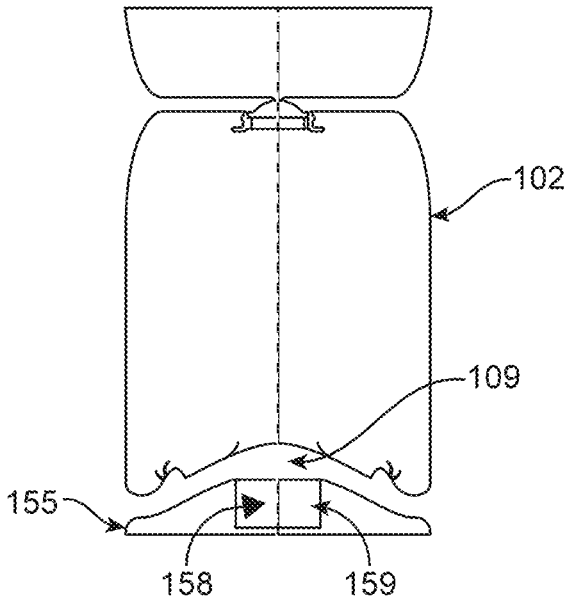
FIG. 2 illustrates a cross-section of an example modified phase plug for an omnidirectional loudspeaker, in accordance with an embodiment.
Figure 3:
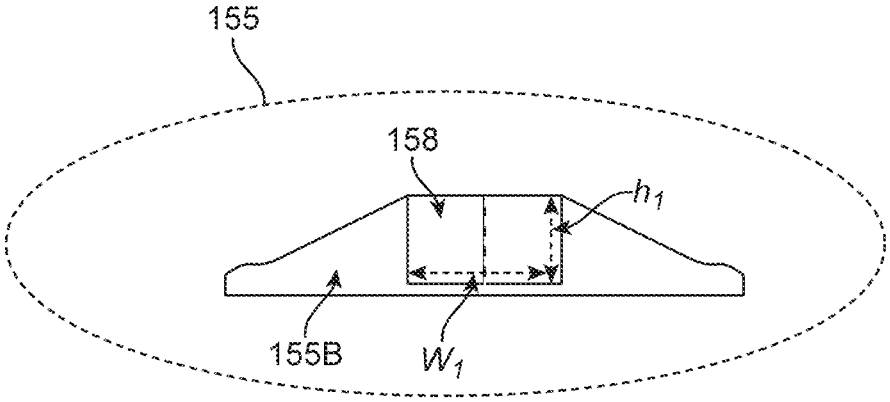
FIG. 3 illustrates a cross-section of an example modified phase plug for an omnidirectional loudspeaker, in accordance with an embodiment.

FIGS. 2-3 each illustrate a cross-section of an example modified phase plug 155 for an omnidirectional loudspeaker 100, in accordance with an embodiment. The modified phase plug 155 comprises a base 155B including an acoustic resonator 159 filled with acoustic damping material 158. The resonator 159 and the acoustic damping material 158 combined provide a physical acoustic filter.

In this specification, $a_1$ denotes an amount (i.e., quantity) of the acoustic damping material 158 used to fill the resonator 159, $t_1$ denotes a type of the acoustic damping material 158, $w_1$ denotes a first dimension (e.g., diameter) of the resonator 159, and $h_1$ denotes a second dimension (e.g., height/depth) of the resonator 159. The dimensions $w_1$ and $h_1$ of the resonator 159 and the amount $a_1$ of the acoustic damping material 158 are not limited to any specific range.

Examples of types of acoustic damping material 158 may include, but are not limited to, fiberglass, Dacron, rockwool, glasswool, foam (e.g., polyethylene foam), and mineral wool. The resonator 159 may comprise only one type of acoustic damping material 158 or a combination of different types of acoustic damping material 158. For example, in one embodiment, fiberglass is used to fully fill the resonator 159.

The resonator 159 is shaped/dimensioned such that the resonator 159 can be precisely tuned to attenuate sound at selected frequencies. Further, "sharpness" of attenuation is based on acoustic damping characteristics of the acoustic damping material 158. For example, if the acoustic damping material 158 has a small amount of acoustic damping, the resonator 159 is effective at attenuating a narrow band of frequencies (i.e., a high Q-factor of attenuation). As another example, if the acoustic damping material 158 has a higher amount of acoustic damping, the resonator 159 provides increased bandwidth at which sound is attenuated but decreased effectiveness (i.e., a low Q-factor of attenuation).

To manufacture the modified phase plug 155, a shape of the resonator 159, dimensions $w_1$ and $h_1$ of the resonator 159, type $t_1$ of acoustic damping material 158 to use, and amount $a_1$ of the acoustic damping material 158 to fill the resonator 159 with are determined based on an application and/or size of the loudspeaker 100.

In one example embodiment, a cross-section of the resonator 159 has, but is not limited to, one of the following three-dimensional (3D) shapes: a sphere (see FIG. 7B as an example), a rectangular prism (see FIG. 7D as an example), a cylinder (see FIG. 7A as an example), an undefined shape (see FIG. 7E as an example), etc.

In one example implementation, the resonator 159 is a cylinder with a height/depth of 28 mm and a diameter of 21 mm.

Figure 4:
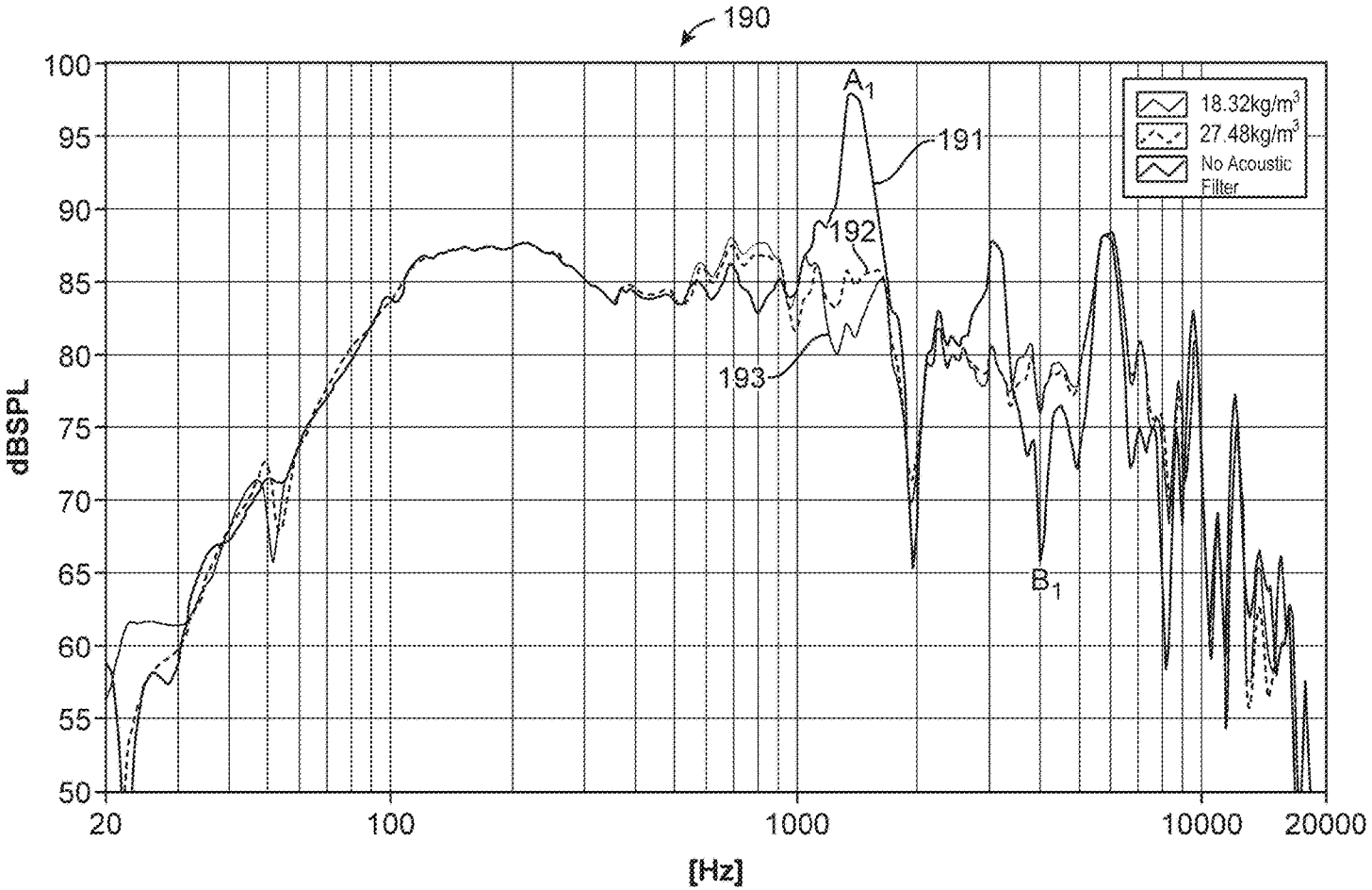
FIG. 4 is an example graph illustrating multiple frequency response curves, in accordance with one embodiment.

FIG. 4 is an example graph 190 illustrating multiple frequency response curves, in accordance with one embodiment. Specifically, the graph 190 shows a first frequency response curve 191 for a loudspeaker 100 without a physical acoustic filter, a second frequency response curve 192 for a loudspeaker 100 with a physical acoustic filter comprising acoustic damping material (e.g., fiberglass) of density 27.48 $kg/m^3$, and a third frequency response curve 193 for a loudspeaker 100 with a physical acoustic filter comprising acoustic damping material (e.g., fiberglass) of density 18.32 $kg/m^3$. The first frequency response curve 191 includes a peak $A_1$ around 1500 Hz and a dip $B_1$ around 4000 Hz. By comparison, as shown by the second and third frequency response curves 192 and 193, the peak $A_1$ around 1500 Hz is eliminated and the dip $B_1$ around 4000 Hz is greatly reduced for a loudspeaker 100 with a physical acoustic filter. Therefore, a physical acoustic filter provided by the modified phase plug 155 reduces magnitude of peaks and dips in a frequency response curve for a loudspeaker 100, thereby enhancing sound quality of the loudspeaker 100.

Further, as demonstrated by the second and third frequency response curves 192 and 193, the amount of acoustic damping material included in a physical acoustic filter also influences frequency response.

In this specification, the term "absorber" generally denotes an acoustic resonator filled with acoustic damping material (i.e., sound absorbing material).

Figure 5A:
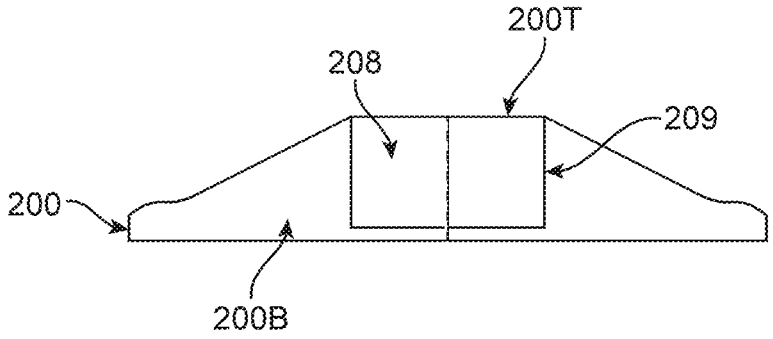
FIG. 5A illustrates a cross-section of another example modified phase plug for an omnidirectional loudspeaker, wherein the modified phase plug includes a flat shaped absorber without a perforated plate, in accordance with an embodiment.

FIG. 5A illustrates a cross-section of another example modified phase plug 200 for an omnidirectional loudspeaker 100, wherein the modified phase plug 200 includes a flat shaped absorber without a perforated plate, in accordance with an embodiment. The modified phase plug 200 comprises a base 200B including an acoustic resonator 209 filled with acoustic damping material 208. The resonator 209 and the acoustic damping material 208 combined provide a physical acoustic filter. The resonator 209 has a flat upper surface (i.e., flat top) 200T. The acoustic damping material 208 is exposed to air in the cavity 109. In one embodiment, a retaining structure (e.g., a wire mesh) may be used to maintain the acoustic damping material 208 in place and prevent the acoustic damping material 208 from falling out of the resonator 209. The retaining structure does not affect the acoustics of the loudspeaker (e.g., does not affect acoustic damping).

Figure 5B:
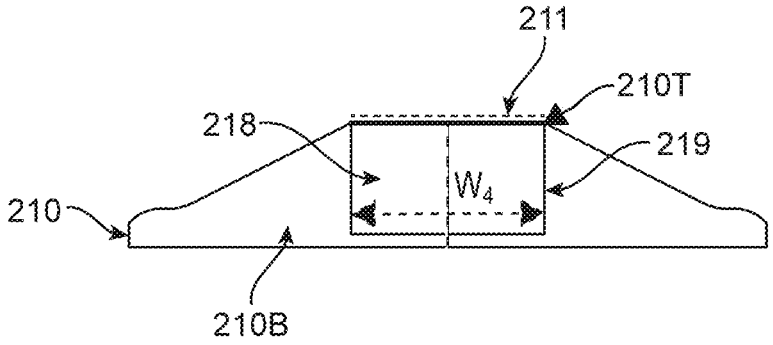
FIG. 5B illustrates a cross-section of another example modified phase plug for an omnidirectional loudspeaker, wherein the modified phase plug includes a flat shaped absorber with a perforated plate, in accordance with an embodiment.

FIG. 5B illustrates a cross-section of another example modified phase plug 210 for an omnidirectional loudspeaker 100, wherein the modified phase plug 210 includes a flat shaped absorber with a perforated plate, in accordance with an embodiment. The modified phase plug 210 comprises a base 210B including an acoustic resonator 219 filled with acoustic damping material 218. The resonator 219 and the acoustic damping material 218 combined provide a physical acoustic filter. The resonator 219 has a flat upper surface 210T.

A perforated plate 211 is attached to (partially) cover the flat upper surface 210T to increase effective acoustic damping and maintain the acoustic damping material 218 in place. The perforated plate 211 improves performance of the acoustic filter and acts as a barrier for the acoustic damping material 218, preventing the acoustic damping material 218 from falling out of the resonator 219. A shape of the perforated plate 211 may be based on a diameter $W_4$ of the resonator 219 and a thickness of the perforated plate 211. The perforated plate 211 may include one or more openings/holes spaced regularly or irregularly across the perforated plate 211. The openings/holes allow soundwaves to propagate into the resonator 219. An open-ratio of the perforated plate 211 (i.e., a ratio indicating how much of the perforated plate 211 includes openings/holes) and a diameter of each opening/hole may be based on application and/or size of the loudspeaker 100. In one embodiment, the diameter of each opening/hole may be less than 2 mm and the open-ratio of the perforated plate 211 may be less than 0.6.

Figure 5C:
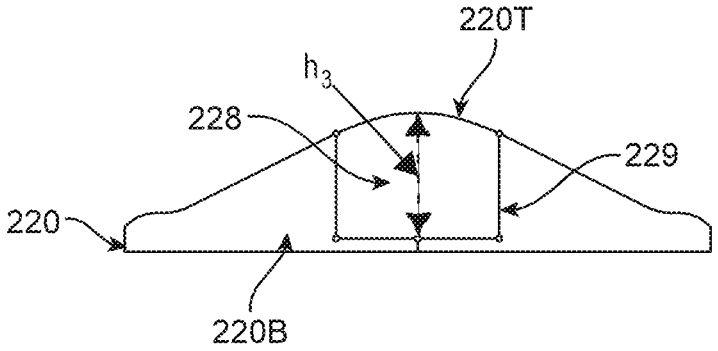
FIG. 5C illustrates a cross-section of another example modified phase plug for an omnidirectional loudspeaker, wherein the modified phase plug includes a curved shaped absorber without a perforated plate, in accordance with an embodiment.

FIG. 5C illustrates a cross-section of another example modified phase plug 220 for an omnidirectional loudspeaker 100, wherein the modified phase plug 220 includes a curved shaped absorber without a perforated plate, in accordance with an embodiment. The modified phase plug 220 comprises a base 220B including an acoustic resonator 229 filled with acoustic damping material 228. The resonator 229 and the acoustic damping material 228 combined provide a physical acoustic filter. The resonator 229 has a curved upper surface (i.e., curved top) 220T. The acoustic damping material 228 is exposed to air in the cavity 109. In one embodiment, a retaining structure (e.g., a wire mesh) may be used to maintain the acoustic damping material 228 in place and prevent the acoustic damping material 228 from falling out of the resonator 229. The retaining structure does not affect the acoustics of the loudspeaker (e.g., does not affect acoustic damping).

A dimension of the resonator 229 may vary over a range. The curved upper surface 220T increases a dimension (e.g., height/depth) of the resonator 229.

Figure 5D:
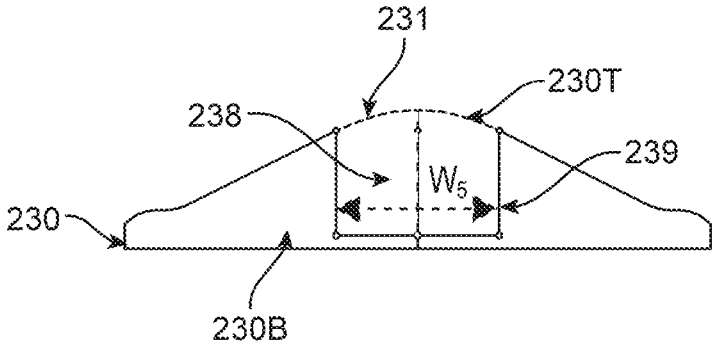
FIG. 5D illustrates a cross-section of another example modified phase plug for an omnidirectional loudspeaker, wherein the modified phase plug includes a curved shaped absorber with a perforated plate, in accordance with an embodiment.

FIG. 5D illustrates a cross-section of another example modified phase plug 230 for an omnidirectional loudspeaker 100, wherein the modified phase plug 230 includes a curved shaped absorber with a perforated plate, in accordance with an embodiment. The modified phase plug 230 comprises a base 230B including an acoustic resonator 239 filled with acoustic damping material 238. The resonator 239 and the acoustic damping material 238 combined provide a physical acoustic filter. The resonator 239 has a curved upper surface 230T.

A perforated plate 231 is attached to a portion of the modified phase plug (e.g., the curved upper surface 230T) to increase effective acoustic damping and maintain the acoustic damping material 238 in place. The perforated plate 231 improves performance of the acoustic filter and acts as a barrier for the acoustic damping material 238, preventing the acoustic damping material 238 from falling out of the resonator 239. A shape of the perforated plate 231 may be based on a diameter $W_5$ of the resonator 239 and a thickness of the perforated plate 231. The perforated plate 231 may include one or more openings/holes spaced regularly or irregularly across the perforated plate 231. The openings/holes allow soundwaves to propagate into the resonator 239. An open-ratio of the perforated plate 231 (i.e., a ratio indicating how much of the perforated plate 231 includes openings/holes) and a diameter of each opening/hole may be based on application and/or size of the loudspeaker 100. In one embodiment, the diameter of each opening/hole may be less than 2 mm and the open-ratio of the perforated plate 231 may be less than 0.6.

Figure 5E:
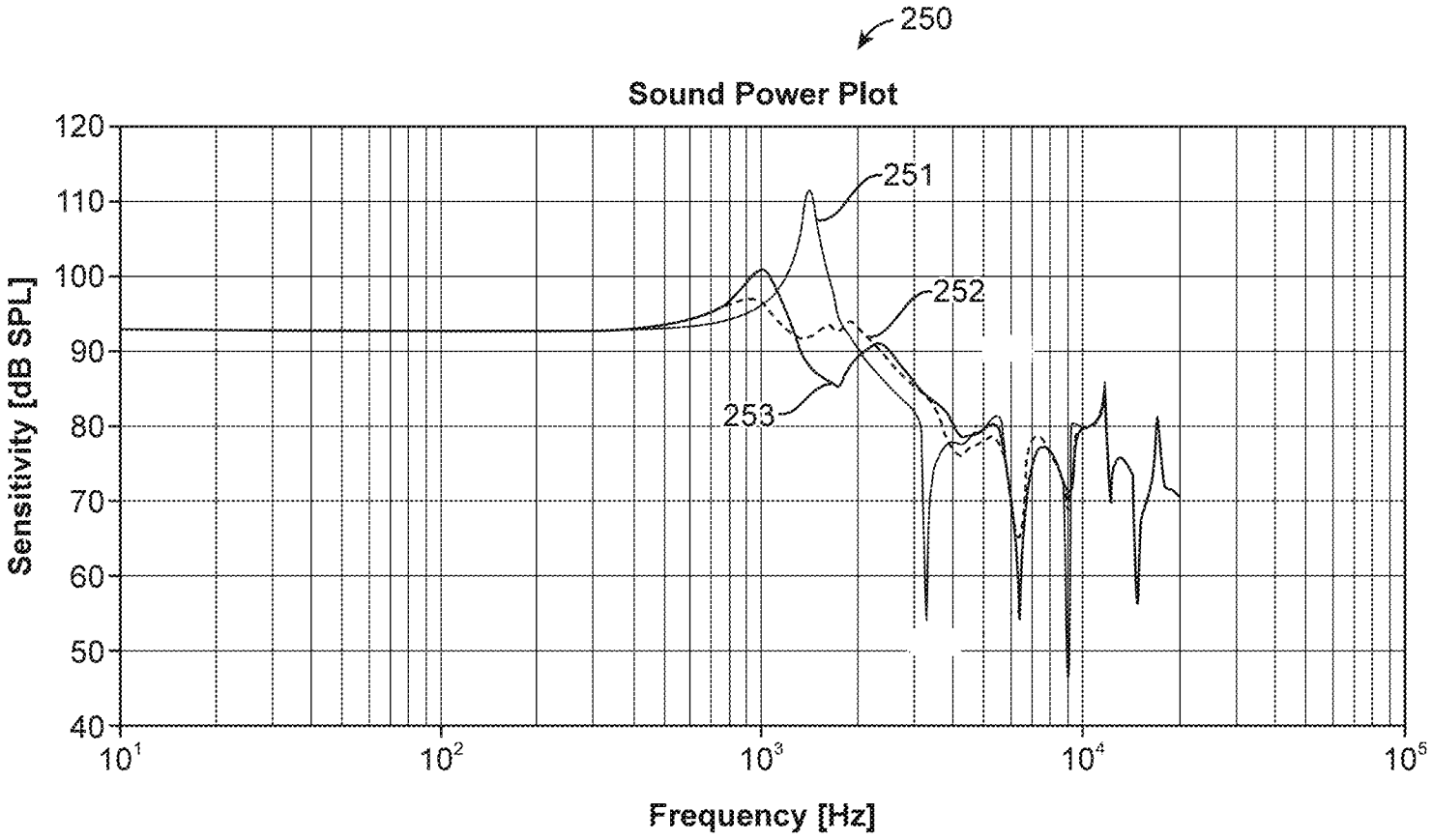
FIG. 5E is another example graph illustrating multiple frequency response curves, in accordance with one embodiment.

FIG. 5E is another example graph 250 illustrating multiple frequency response curves, in accordance with one embodiment. Specifically, the graph 250 shows a first frequency response curve 251 for a loudspeaker 100 without a physical acoustic filter, a second frequency response curve 252 for a loudspeaker 100 with a curved shaped absorber with a perforated plate, and a third frequency response curve 253 for a loudspeaker 100 with a flat shaped absorber with a perforated plate. As demonstrated by the second and third frequency response curves 252 and 253, modified phase plugs 210 and 230 reduce magnitude of peaks and dips in a frequency response curve for a loudspeaker 100, thereby enhancing sound quality of the loudspeaker 100.

Figure 5F:
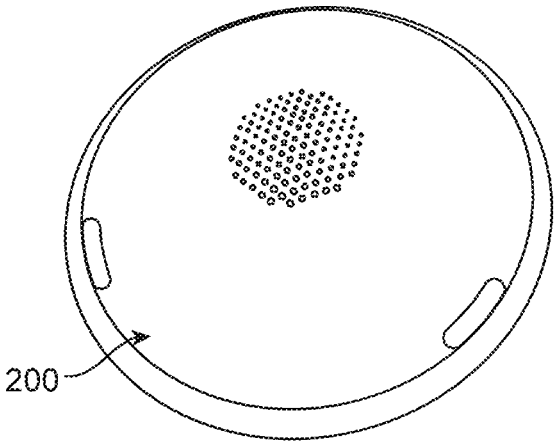
FIG. 5F illustrates a top view of an example modified phase plug for an omnidirectional loudspeaker, wherein the modified phase plug includes a curved shaped absorber with a perforated plate, in accordance with an embodiment.

FIG. 5F illustrates a top view of an example modified phase plug 200 for an omnidirectional loudspeaker 100, wherein the modified phase plug 200 includes a curved shaped absorber with a perforated plate, in accordance with an embodiment.

Figure 5G:
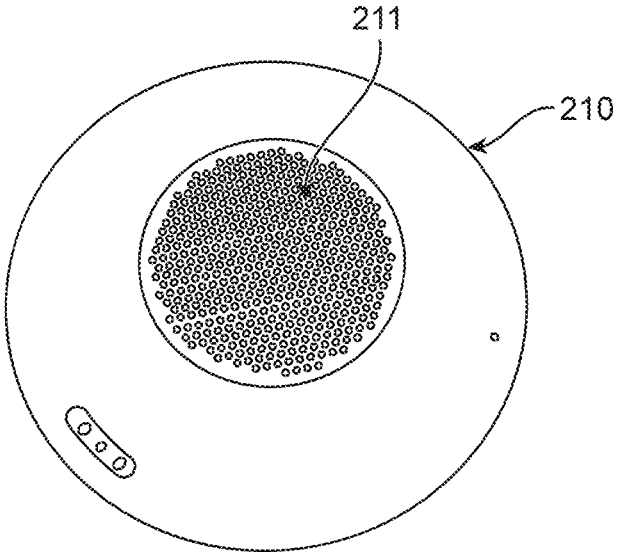
FIG. 5G illustrates a top view of an example modified phase plug for an omnidirectional loudspeaker, wherein the modified phase plug includes a flat shaped absorber with a perforated plate, in accordance with an embodiment.

FIG. 5G illustrates a top view of an example modified phase plug 210 for an omnidirectional loudspeaker 100, wherein the modified phase plug 210 includes a flat shaped absorber with a perforated plate 211, in accordance with an embodiment.

Figure 5H:
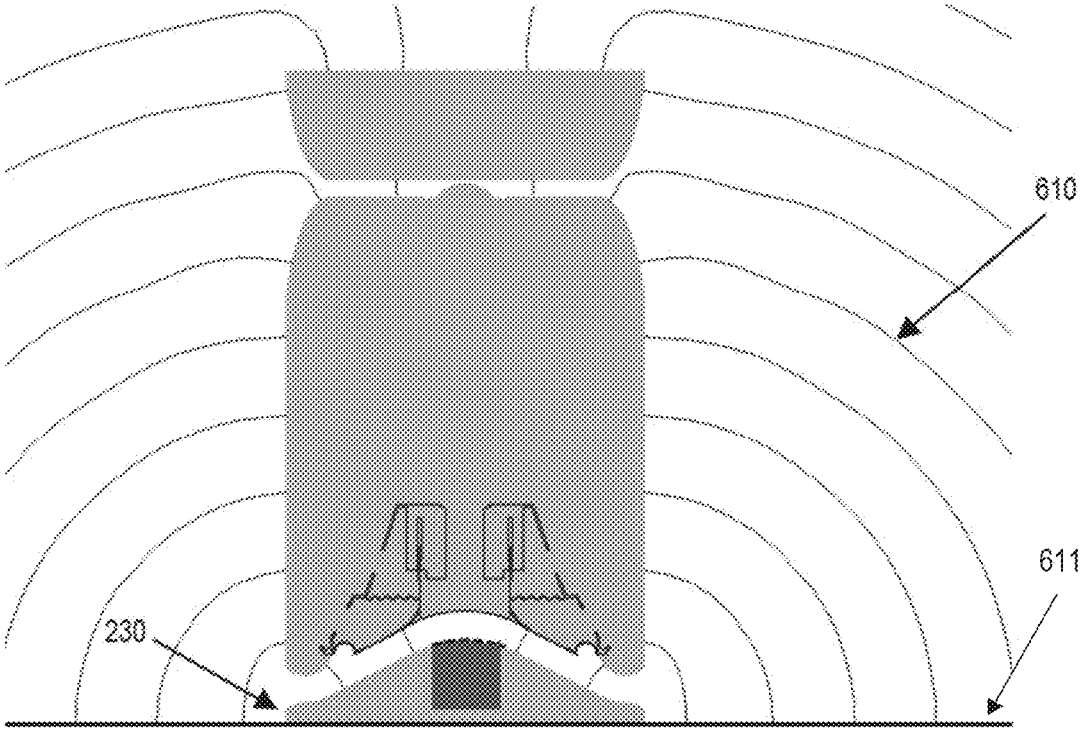
FIG. 5H illustrates sound pressure wave fronts around an omnidirectional loudspeaker in operation, in accordance with an embodiment.

FIG. 5H illustrates sound pressure wave fronts 610 around an omnidirectional loudspeaker 100 in operation, in accordance with an embodiment. The loudspeaker 100 is rested on top of a flat surface 611. The loudspeaker 100 includes a modified phase plug 230.

Figure 6B:
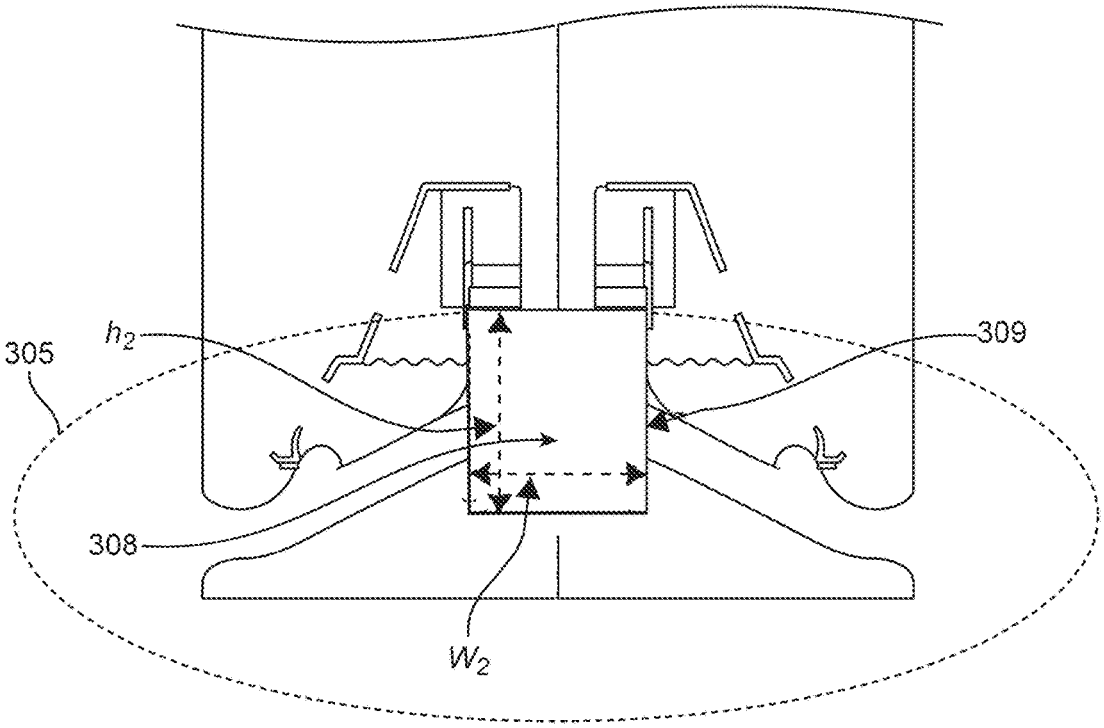
FIG. 6B illustrates a cross-section of an example protruding phase plug for an omnidirectional loudspeaker, in accordance with an embodiment.

One embodiment provides a protruding phase plug for an omnidirectional loudspeaker 100. FIGS. 6A-6B each illustrate a cross-section of an example protruding phase plug 305 for an omnidirectional loudspeaker 100, in accordance with an embodiment. The protruding phase plug 305 comprises a base 305B and a protruding portion 305P extending from a central area of the base 305B. The protruding portion 305P extends into an interior cavity 102A (FIG. 1) of a first enclosure 102 of the loudspeaker 100.

Specifically, as shown in FIGS. 6A-6B, the protruding portion 305P extends past the diaphragm 106 (in a rest position) of the loudspeaker 100, and into the region 106S (FIG. 1) of space between the diaphragm 106 and the transducer 107 of the loudspeaker 100. The diaphragm 106 includes an opening 106H (i.e., a hole) shaped for receiving the protruding portion 305P. The opening 106H is positioned at a center of the diaphragm 106.

The protruding phase plug 305 provides a physical acoustic filter comprising a resonator 309 filled with acoustic damping material 308.

In this specification, $a_2$ denotes an amount (i.e., quantity) of the acoustic damping material 308 used to fill the resonator 309, $t_2$ denotes a type of the acoustic damping material 308, $w_2$ denotes a first dimension (e.g., diameter) of the resonator 309, and $h_2$ denotes a second dimension (e.g., height) of the resonator 309. The dimensions $w_2$ and $h_2$ of the resonator 309 and the amount $a_1$ of the acoustic damping material 308 are not limited to any specific range.

Examples of types of acoustic damping material 308 may include, but are not limited to, fiberglass, Dacron, rockwool, glasswool, foam (e.g., polyethylene foam), and mineral wool. The resonator 308 may comprise only one type of acoustic damping material 308 or a combination of different types of acoustic damping material 308. For example, in one embodiment, fiberglass is used to fully fill the resonator 309.

To manufacture the protruding phase plug 305, a shape of the resonator 309, dimensions $w_2$ and $h_2$ of the resonator 309, type $t_2$ of acoustic damping material 308 to use, and amount $a_2$ of the acoustic damping material 308 to fill the resonator 309 with are determined based on an application and/or size of the loudspeaker 100.

In one example embodiment, a cross-section of the resonator 309 has, but is not limited to, one of the following three-dimensional (3D) shapes: a sphere (see FIG. 7B as an example), a rectangular prism (see FIG. 7D as an example), a cylinder (see FIG. 7A as an example), an undefined shape (see FIG. 7E as an example), etc.

In one example implementation, the resonator 309 is a rectangular prism with a height of 50 mm and a diameter of 15 mm.

Figure 6C:
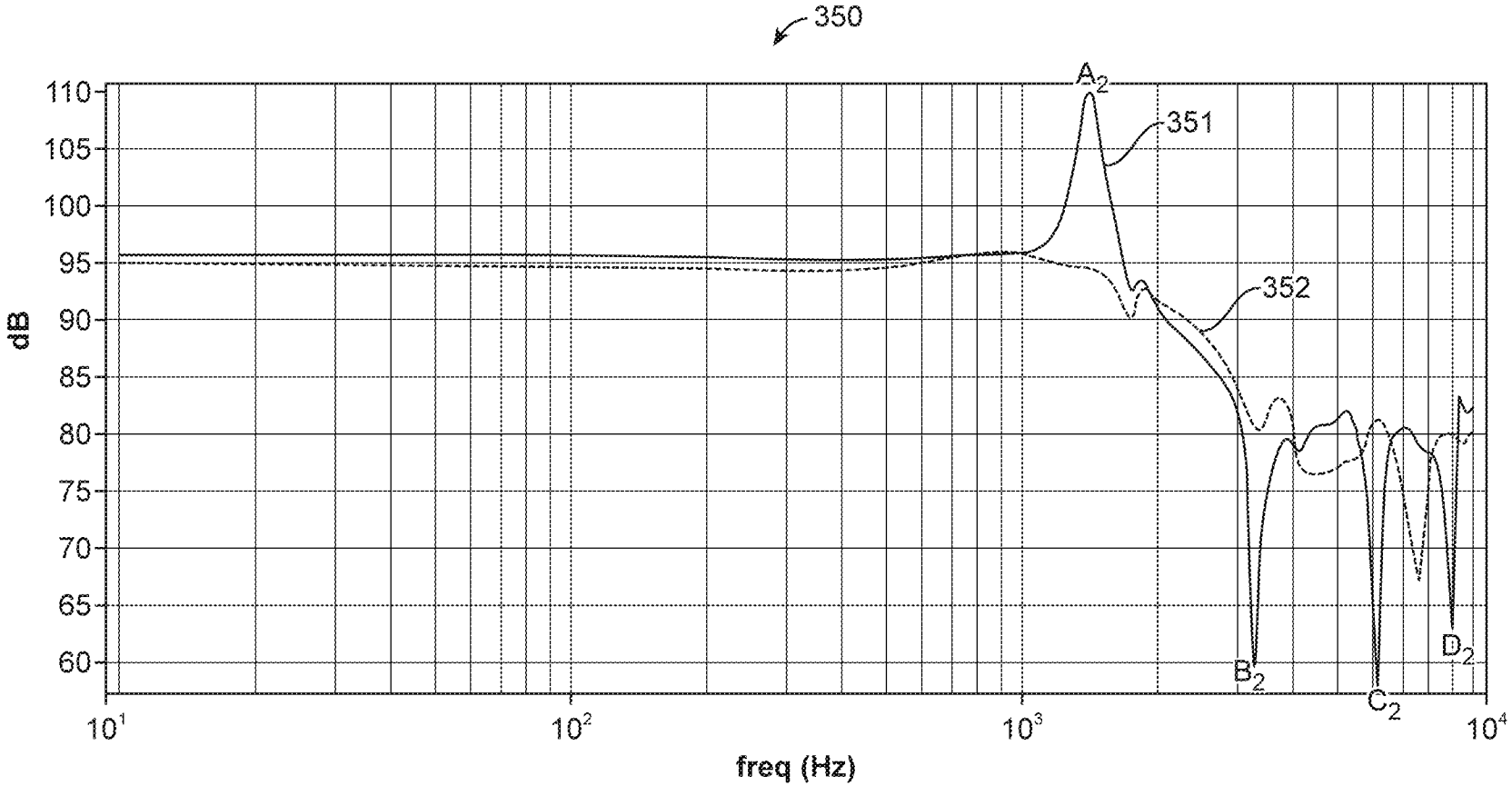
FIG. 6C is another example graph illustrating multiple frequency response curves, in accordance with one embodiment.

FIG. 6C is another example graph 350 illustrating multiple frequency response curves, in accordance with one embodiment. Specifically, the graph 350 shows a first frequency response curve 351 for a loudspeaker 100 without a physical acoustic filter, and a second frequency response curve 352 for a loudspeaker 100 with a protruding phase plug 305. The first frequency response curve 351 includes a peak $A_2$ around 1500 Hz, a dip $B_2$ around 4000 Hz, and additional dips $C_2$ and $D_2$ around 6000 Hz and 9000 Hz respectively. By comparison, as shown by the second frequency response curve 352, the peak $A_2$ around 1500 Hz and the dip $B_2$ around 4000 Hz are eliminated, and the additional dips $C_2$ and $D_2$ around 6000 Hz and 9000 Hz respectively are greatly reduced for a loudspeaker 100 with a protruding phase plug 305. Therefore, a protruding phase plug 305 reduces magnitude of peaks and dips in a frequency response curve for a loudspeaker 100, thereby enhancing sound quality of the loudspeaker 100.

Figure 6D:
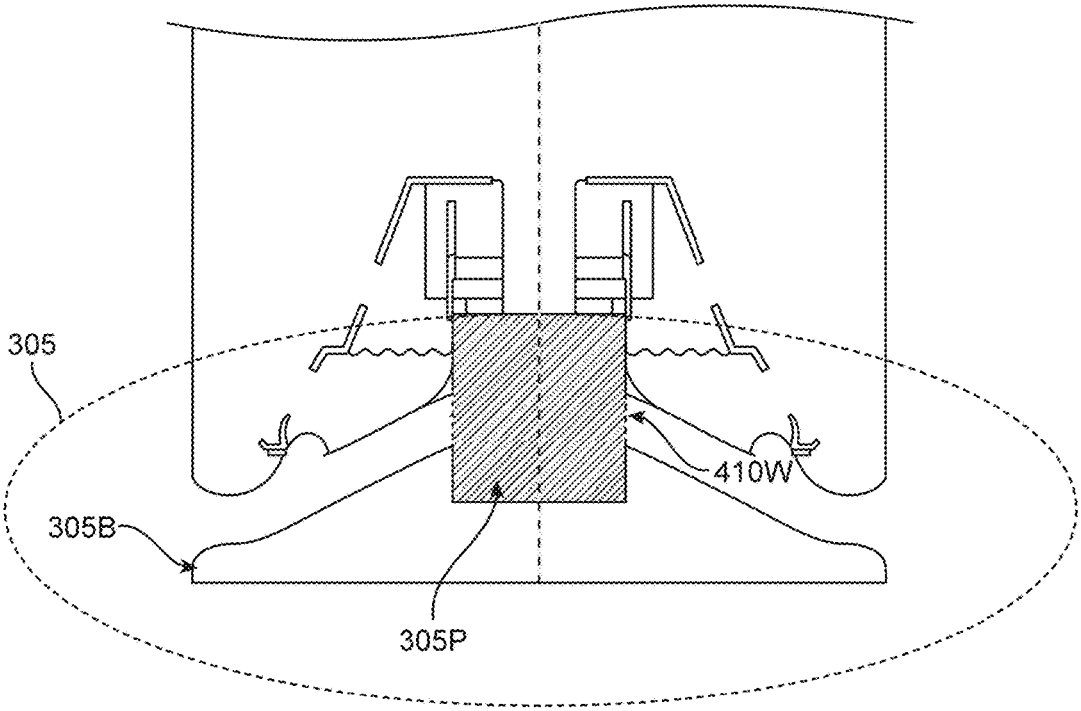
FIG. 6D illustrates a cross-section of the protruding phase plug with a perforated plate, in accordance with an embodiment.

FIG. 6D illustrates a cross-section of the protruding phase plug 305 with a perforated ring 410W, in accordance with an embodiment. To increase effective acoustic damping of the resonator 309, a single encircling perforated ring 410W may be attached to an exposed region 305E (FIG. 6F) of the protruding portion 305P that is exposed to air.

Figure 6E:
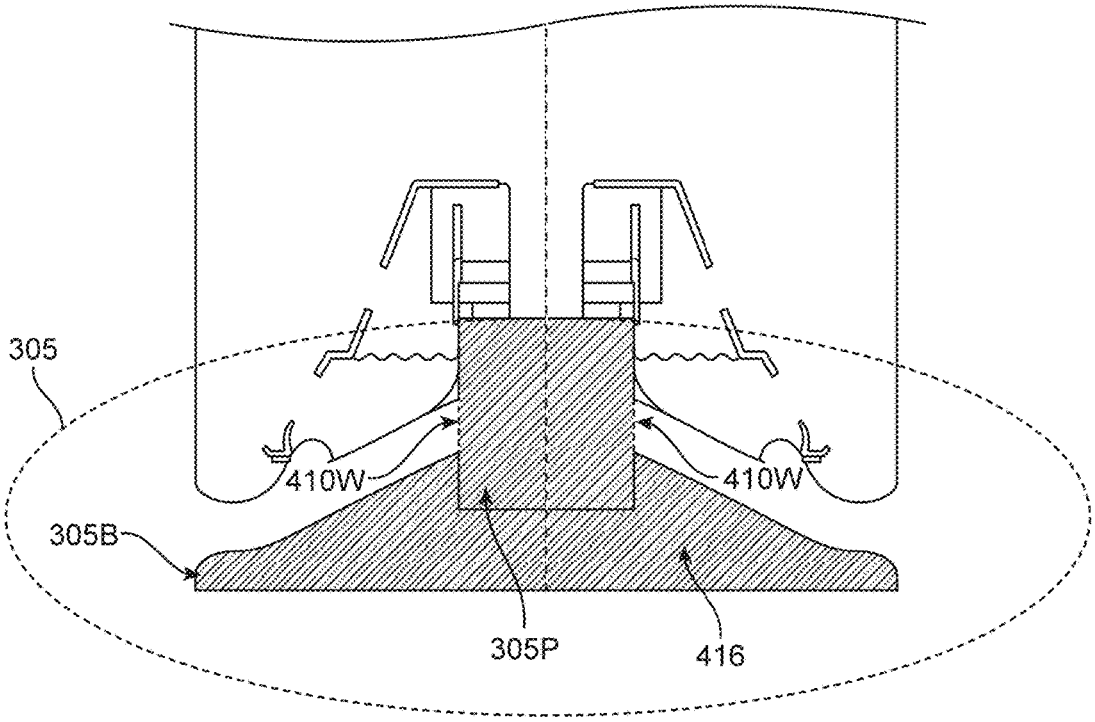
FIG. 6E illustrates a cross-section of the protruding phase plug with a perforated plate and an extended absorber, in accordance with an embodiment.

FIG. 6E illustrates a cross-section of the protruding phase plug 305 with a perforated ring 410W and an extended absorber 416, in accordance with an embodiment. In one embodiment, the base 305B may be filled with additional acoustic damping material to form an extended absorber 416. The extended absorber 416 helps to attenuate peaks at lower frequencies.

Figure 6F:
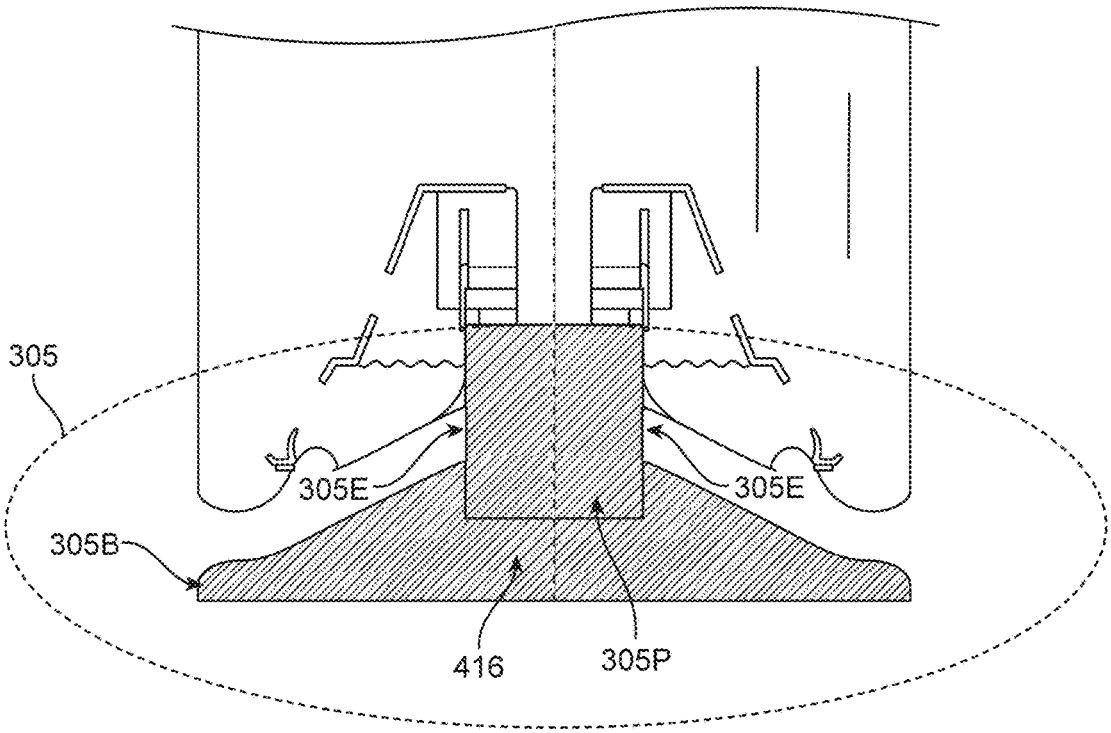
FIG. 6F illustrates a cross-section of the protruding phase plug with an extended absorber and without a perforated plate, in accordance with an embodiment.

FIG. 6F illustrates a cross-section of the protruding phase plug 305 with an extended absorber 416 and without a perforated ring, in accordance with an embodiment. Some acoustic damping material inside the protruding portion 305P is in direct contact with air surrounding an exposed region 305E of the protruding portion 305P.

Figure 6G:
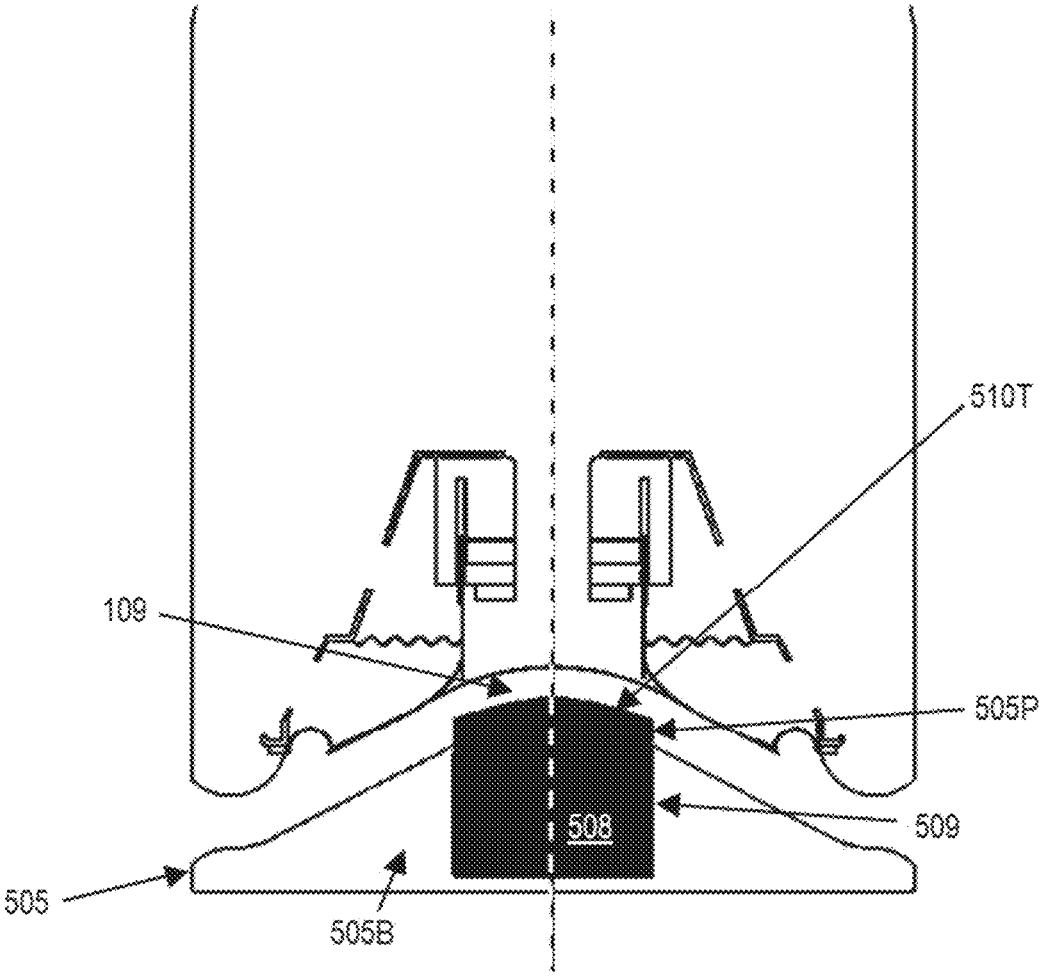
FIG. 6G each illustrate a cross-section of an example protruding phase plug for an omnidirectional loudspeaker, in accordance with an embodiment.

FIG. 6G each illustrate a cross-section of an example protruding phase plug 505 for an omnidirectional loudspeaker 100, in accordance with an embodiment. The protruding phase plug 505 comprises a base 505B and a protruding portion 505P extending from a central area of the base 305B. Unlike the protruding phase plug 305, the protruding portion 505P extends only into the cavity 109. The protruding phase plug 505 provides a physical acoustic filter comprising a resonator 509 filled with acoustic damping material 508. The protruding phase plug 505 has a curved upper surface 510T.

Figure 6H:
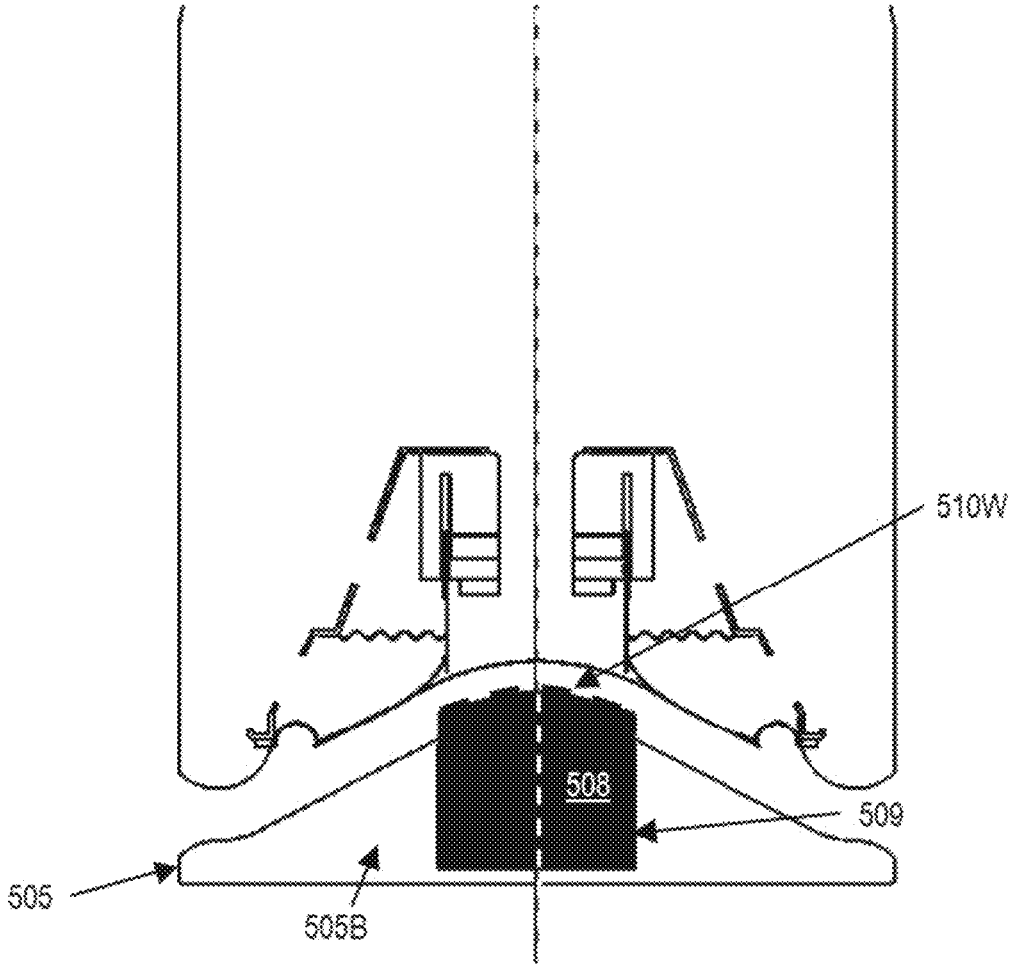
FIG. 6H illustrates a cross-section of the protruding phase plug with a perforated plate, in accordance with an embodiment.

FIG. 6H illustrates a cross-section of the protruding phase plug 505 with a perforated plate 510W, in accordance with an embodiment. To increase effective acoustic damping of the resonator 509, a perforated ring 410W may be attached to a region of the protruding portion 505P that is exposed to air.

Figure 7A:
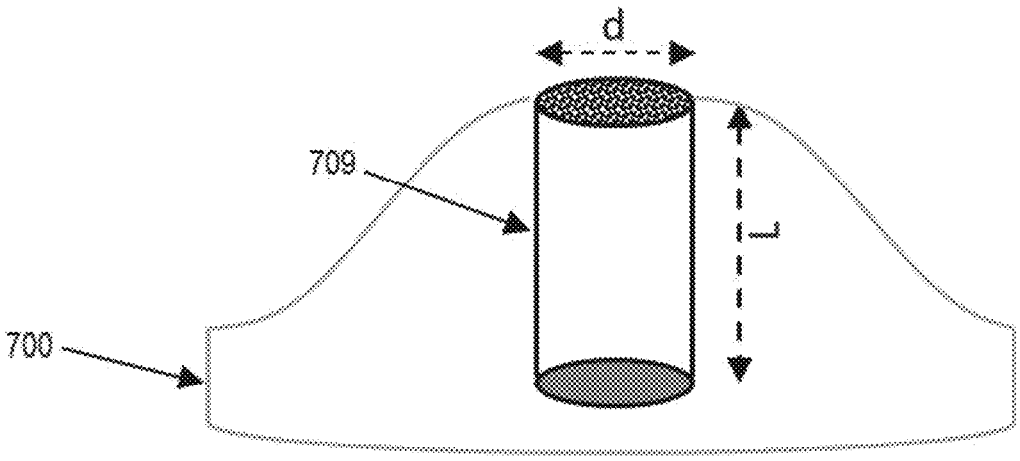
FIG. 7A illustrates a cross-section of an example modified phase plug comprising a cylindrical shaped resonator, in accordance with an embodiment.

FIG. 7A illustrates a cross-section of an example modified phase plug 700 comprising a cylindrical shaped resonator 709, in accordance with an embodiment. As shown in FIG. 7A, the resonator 709 lies flush inside the modified phase plug 700 (i.e., does not extend/protrude into the cavity 109).

In this specification, $f_{amplify}$, denotes frequencies (in units of Hz) amplified by a resonator, $f_{attenuate}$ denotes frequencies (in units of Hz) attenuated by the resonator, n denotes an integer number, and v denotes speed of sound in air in units of meters/second.

In one embodiment, for a cylindrical shaped resonator 709, $f_{amplify}$, is represented in accordance with equation (1) provided below:

$$f_{amplify}=nv/[4(L+0.4d], \quad (1)$$

wherein L denotes a length of the resonator 709 in units of meter, d denotes a diameter of the resonator 709 in units of meter, and n is an odd integer number.

In one embodiment, for a cylindrical shaped resonator 709, $f_{attenuate}$ is represented in accordance with equation (2) provided below:

$$f_{attenuate}=nv/[4(L+0.4d)], \quad (2)$$

wherein n is an even integer number.

Figure 7B:
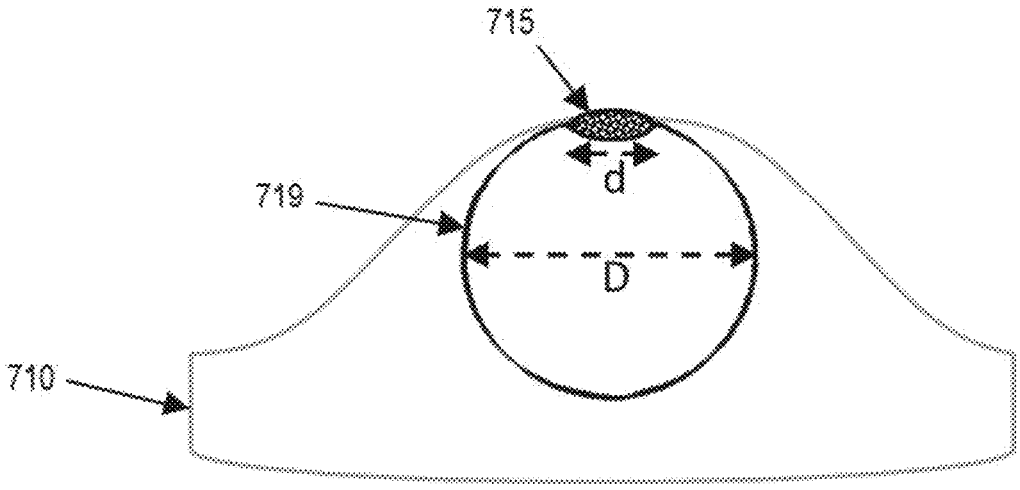
FIG. 7B illustrates a cross-section of an example modified phase plug comprising a spherical shaped resonator, in accordance with an embodiment.

FIG. 7B illustrates a cross-section of an example modified phase plug 710 comprising a spherical shaped resonator 719, in accordance with an embodiment. As shown in FIG. 7B, the resonator 719 lies flush inside the modified phase plug 710 (i.e., does not extend/protrude into the cavity 109).

The resonator attenuates frequencies (in units of Hz) around $f_{resonance}$. In one embodiment, for a spherical shaped resonator 719, $f_{resonance}$ is represented in accordance with equation (3) provided below:

$$f_{resonance}=(v/\pi)*(3d/6.8D^3)^{1/2}, \quad (3)$$

wherein D denotes a diameter at a center of the resonator 719 in units of meter, and d denotes a diameter at a top section 715 of the resonator 719 in units of meter.

Figure 7C:
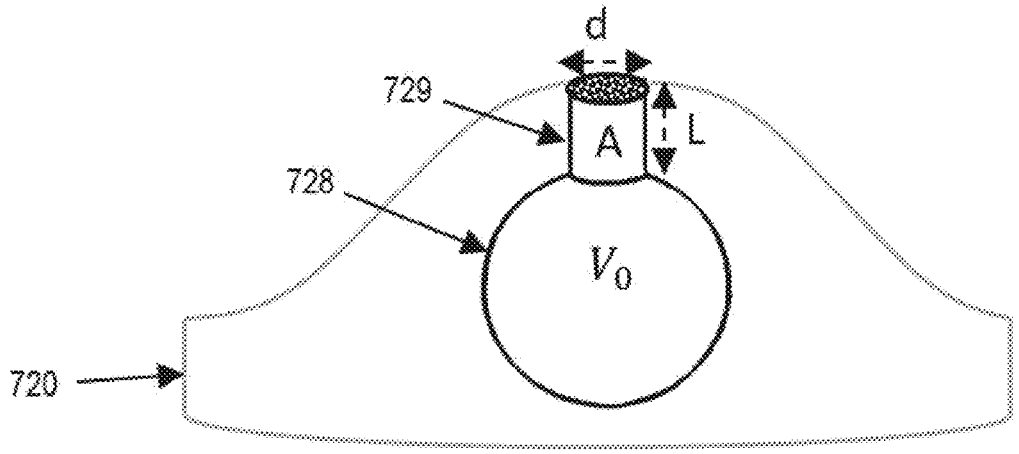
FIG. 7C illustrates a cross-section of an example modified phase plug comprising a Helmholtz resonator, in accordance with an embodiment.

FIG. 7C illustrates a cross-section of an example modified phase plug 720 comprising a Helmholtz resonator, in accordance with an embodiment. As shown in FIG. 7C, the Helmholtz resonator comprises a spherical resonator 728 including a cylindrical neck 729 extending from a top of the spherical resonator 728. The Helmholtz resonator lies flush inside the modified phase plug 720 (i.e., does not extend/protrude into the cavity 109).

In one embodiment, for a Helmholtz resonator, $f_{resonance}$ is represented in accordance with equation (4) provided below:

$$f_{resonance}=(v/\pi)*(A/V_0L_{eq})^{1/2}, \quad (4)$$

wherein A denotes a cross-sectional area of the neck 729, L denotes a length of the neck 729, $V_0$ denotes a volume of the resonator 728, $L_{eq}$ is either L+0.75d (if the neck 729 is unflanged, i.e., the neck 729 protrudes into the cavity 109) or L+0.85d (if the neck 729 is flanged, i.e., the neck 729 ends at a surface of the modified phase plug 720), and d denotes a diameter of the neck 729.

Figure 7D:
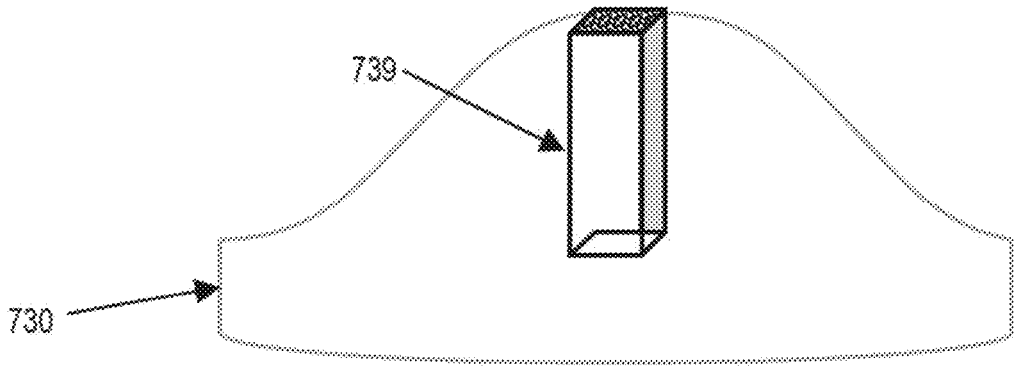
FIG. 7D illustrates a cross-section of an example modified phase plug comprising a rectangular prism shaped resonator, in accordance with an embodiment.

FIG. 7D illustrates a cross-section of an example modified phase plug 730 comprising a rectangular prism shaped resonator 739, in accordance with an embodiment. The resonator 739 lies flush inside the modified phase plug 730 (i.e., does not extend/protrude into the cavity 109).

Figure 7E:
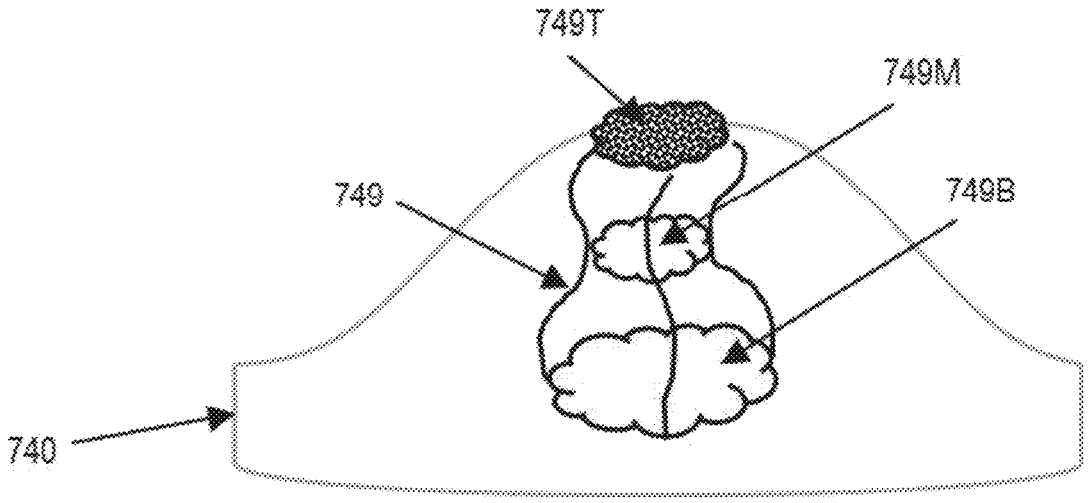
FIG. 7E illustrates a cross-section of an example modified phase plug comprising an irregular shaped resonator, in accordance with an embodiment.

FIG. 7E illustrates a cross-section of an example modified phase plug 740 comprising an irregular shaped resonator 749, in accordance with an embodiment. As shown in FIG. 7E, a top section 749T, a middle section 749M, and a bottom section 749B of the resonator 749 have different shapes. The resonator 749 lies flush inside the modified phase plug 740 (i.e., does not extend/protrude into the cavity 109).

Figure 8:
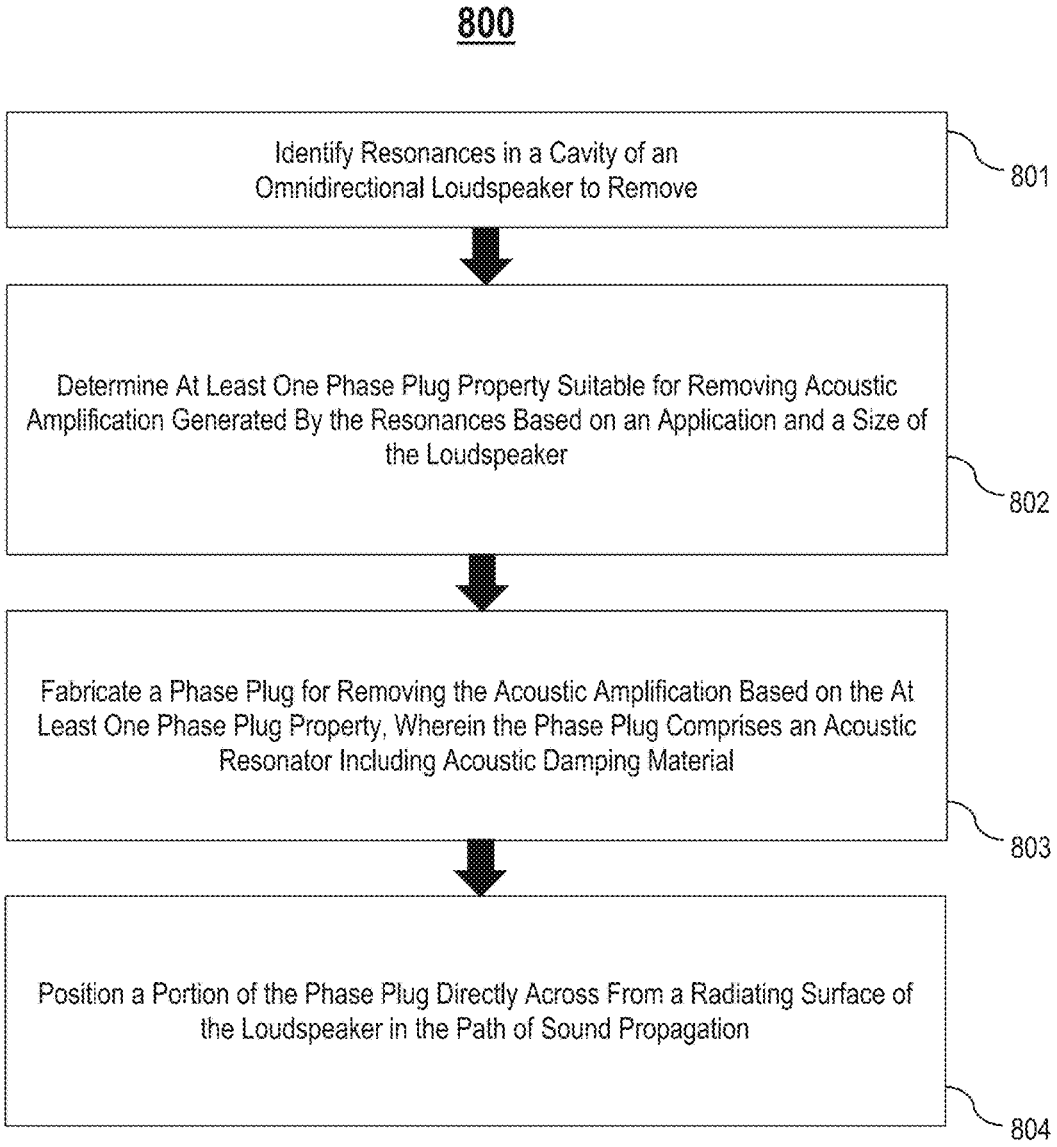
FIG. 8 is an example flowchart of a manufacturing process for producing a phase plug for an omnidirectional loudspeaker, in accordance with an embodiment of the invention.

FIG. 8 is an example flowchart of a manufacturing process 800 for producing a phase plug for an omnidirectional loudspeaker, in accordance with an embodiment of the invention. In process block 801, identify resonances in a cavity of the omnidirectional loudspeaker to remove.

In process block 802, determine at least one phase plug property suitable for removing acoustic amplification generated by the resonances based on an application and a size of the omnidirectional loudspeaker.

In process block 803, fabricate a phase plug for removing the acoustic amplification based on the at least one phase plug property, wherein the phase plug comprises an acoustic resonator including acoustic damping material.

In process block 804, position a portion of the phase plug directly across from a radiating surface of the omnidirectional loudspeaker in the path of sound propagation.

Figure 9:
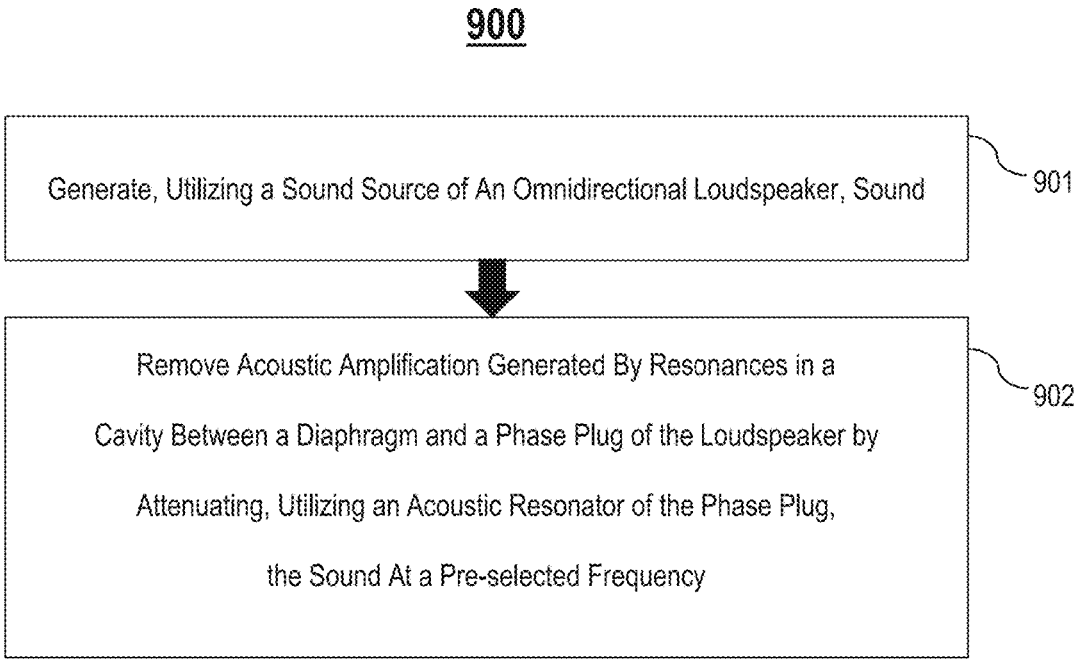
FIG. 9 is an example flowchart for removing acoustic amplification in a cavity between a diaphragm and a phase plug of an omnidirectional loudspeaker, in accordance with an embodiment of the invention.

FIG. 9 is an example flowchart 900 for removing acoustic amplification in a cavity between a diaphragm and a phase plug of an omnidirectional loudspeaker, in accordance with an embodiment of the invention. In process block 901, generate, utilizing a sound source of the omnidirectional loudspeaker, sound.

In process block 902, remove acoustic amplification generated by resonances in the cavity by attenuating, utilizing an acoustic resonator of the phase plug, the sound at a pre-selected frequency Though the embodiments have been described with reference to certain versions thereof; however, other versions are possible. Therefore, the spirit and scope of the appended claims should not be limited to the description of the preferred versions contained herein.

What is claimed is:

1. An omnidirectional loudspeaker, comprising:

a phase plug comprising a base;

a radiating surface positioned above and separate from the phase plug; and an acoustic resonator disposed within a portion of the base, wherein the acoustic resonator is at least partially filled with acoustic damping material, the acoustic resonator and the acoustic damping material combined attenuate sound at a frequency that is based at least in part on a physical characteristic of the acoustic resonator, and a portion of the acoustic resonator including a portion of the acoustic damping material is positioned in a path of sound propagation and protrudes into a cavity between the radiating surface and the phase plug.

2. The omnidirectional loudspeaker of claim 1, wherein the acoustic resonator is tuned to attenuate sound at a pre-selected frequency.

3. The omnidirectional loudspeaker of claim 1, wherein the acoustic resonator removes acoustic amplification created by resonances in the cavity.

4. The omnidirectional loudspeaker of claim 3, wherein the acoustic damping material tunes a Q-factor of attenuation to a Q-factor of the resonances in the cavity.

5. The omnidirectional loudspeaker of claim 3, wherein the acoustic resonator has a curved upper surface.

6. The omnidirectional loudspeaker of claim 5, wherein a perforated plate conforms to the curved upper surface.

7. The omnidirectional loudspeaker of claim 1, wherein the acoustic resonator has a flat upper surface.

8. The omnidirectional loudspeaker of claim 7, wherein a perforated plate is on the flat upper surface.

9. The omnidirectional loudspeaker of claim 1, further comprising:

an axisymmetric loudspeaker enclosure, wherein the radiating surface is disposed inside the axisymmetric loudspeaker enclosure; and a transducer disposed inside the axisymmetric loudspeaker enclosure;

wherein the portion of the acoustic resonator including the portion of the acoustic damping material extends through a recess of the radiating surface and into a region of space between the radiating surface and a former of the transducer inside the axisymmetric loudspeaker enclosure.

10. The omnidirectional loudspeaker of claim 9, wherein a perforated ring is attached to a region of the portion of the acoustic resonator including the portion of the acoustic damping material exposed to air in the cavity.

11. The omnidirectional loudspeaker of claim 1, wherein a remaining portion of the base of the phase plug comprises additional acoustic damping material.

12. A method for producing a phase plug for an omnidirectional loudspeaker including a radiating surface, comprising:

identifying resonances in a cavity of the omnidirectional loudspeaker to remove; and fabricating a phase plug for removing acoustic amplification generated by the resonances, wherein the radiating surface is positioned above and separate from the phase plug, the phase plug comprises a base including an acoustic resonator disposed within a portion of the base, the acoustic resonator is at least partially filled with acoustic damping material, the acoustic resonator and the acoustic damping material combined attenuate sound at a frequency that is based at least in part on a physical characteristic of the acoustic resonator, and a portion of the acoustic resonator including a portion of the acoustic damping material is positioned in a path of sound propagation and protrudes into a cavity between the radiating surface and the phase plug.

13. The method of claim 12, further comprising:

determining at least one phase plug property suitable for removing the acoustic amplification based on an application and a size of the omnidirectional loudspeaker, wherein the phase plug is fabricated based on the at least one phase plug property, and the at least one phase plug property includes a physical characteristic of the acoustic resonator.

14. The method of claim 13, wherein the determining at least one phase plug property comprises:

determining a shape of the acoustic resonator;

determining a dimension of the acoustic resonator;

determining a type of the acoustic damping material; and determining an amount of the acoustic damping material required to fill the acoustic resonator.

15. The method of claim 12, further comprising:

positioning the portion of the acoustic resonator including the portion of the acoustic damping material directly across from the radiating surface in the path of sound propagation.

16. The method of claim 15, wherein the portion of the acoustic resonator including the portion of the acoustic damping material extends into the cavity.

17. The method of claim 16, further comprising:

attaching perforated ring to a region of the portion of the acoustic resonator including the portion of the acoustic damping material exposed to air in the cavity.

18. The method of claim 12, further comprising:

tuning the acoustic resonator to attenuate sound generated by a sound source of the omnidirectional loudspeaker at a pre-selected frequency.

19. A method for removing acoustic amplification in a cavity between a diaphragm and a phase plug of an omnidirectional loudspeaker, comprising:

generating, utilizing a sound source of the omnidirectional loudspeaker, sound; and removing acoustic amplification generated by resonances in the cavity utilizing the phase plug, wherein the diaphragm is positioned above and separate from the phase plug, the phase plug comprises a base including an acoustic resonator disposed within a portion of the base, the acoustic resonator is at least partially filled with acoustic damping material, the acoustic resonator and the acoustic damping material combined attenuate the sound at a frequency that is based at least in part on a physical characteristic of the acoustic resonator, and a portion of the acoustic resonator including a portion of the acoustic damping material is positioned in a path of sound propagation and protrudes into a cavity between the diaphragm and the phase plug.

20. The method of claim 19, wherein the acoustic damping material tunes a Q-factor of attenuation to a Q-factor of the resonances in the cavity.

* * * * *